US012668861B2

(12) United States Patent
Isozaki et al.

(10) Patent No.: US 12,668,861 B2
(45) Date of Patent: Jun. 30, 2026

(54) AUSTENITE STAINLESS STEEL MATERIAL, METHOD FOR PRODUCING SAME, AND DESIGNED ARTICLES

(71) Applicant: NIPPON STEEL Stainless Steel Corporation, Tokyo (JP)

(72) Inventors: Seiichi Isozaki, Tokyo (JP); Yasushi Nishimura, Tokyo (JP); Naoki Hirakawa, Tokyo (JP)

(73) Assignee: NIPPON STEEL STAINLESS STEEL CORPORATION, Tokyo (JP)

( * ) Notice: Subject to any disclaimer, the term of this patent is extended or adjusted under 35 U.S.C. 154(b) by 185 days.

(21) Appl. No.: 18/290,099

(22) PCT Filed: Jul. 6, 2022

(86) PCT No.: PCT/JP2022/026840

§ 371 (c)(1),
(2) Date: Nov. 9, 2023

(87) PCT Pub. No.: WO2023/013353

PCT Pub. Date: Feb. 9, 2023

(65) Prior Publication Data

US 2024/0254608 A1 Aug. 1, 2024

(30) Foreign Application Priority Data

Aug. 2, 2021 (JP) ..... 2021-126710

(51) Int. Cl.

| | |
|---|---|
| ***C22C 38/46*** | (2006.01) |
| ***C21D 8/0221*** | (2026.01) |
| ***C22C 38/00*** | (2006.01) |
| ***C22C 38/34*** | (2006.01) |
| ***C22C 38/44*** | (2006.01) |
| ***C22C 38/52*** | (2006.01) |
| ***C22C 38/54*** | (2006.01) |
| ***C22C 38/58*** | (2006.01) |

(52) U.S. Cl.

CPC ..... *C22C 38/58* (2013.01); *C21D 8/0226* (2013.01); *C22C 38/001* (2013.01); *C22C 38/002* (2013.01); *C22C 38/34* (2013.01); *C22C 38/44* (2013.01); *C22C 38/46* (2013.01); *C22C 38/52* (2013.01); *C22C 38/54* (2013.01); *C21D 2211/001* (2013.01); *C21D 2211/005* (2013.01)

(58) Field of Classification Search

CPC ..... C22C 38/44

See application file for complete search history.

(56) References Cited

U.S. PATENT DOCUMENTS

| | | | | |
|---|---|---|---|---|
| 10,894,995 | B2 * | 1/2021 | Hamada | C22C 38/04 |
| 11,339,462 | B2 * | 5/2022 | Hirata | C22C 38/06 |
| 11,634,804 | B2 * | 4/2023 | Jotoku | C22C 38/002 403/272 |
| 12,054,797 | B2 * | 8/2024 | Osuki | C22C 38/46 |
| 12,188,111 | B2 * | 1/2025 | Osuki | C21D 8/0247 |
| 2006/0193743 | A1 * | 8/2006 | Semba | C22C 38/02 420/53 |
| 2011/0064649 | A1 | 3/2011 | Semba et al. | |
| 2020/0299816 | A1 | 9/2020 | Kim et al. | |
| 2023/0047414 | A1 * | 2/2023 | Hatano | C21D 8/0226 |
| 2023/0076254 | A1 * | 3/2023 | Yoshimi | C22C 38/06 |
| 2023/0126782 | A1 * | 4/2023 | Matsuhashi | C22C 38/004 428/683 |
| 2023/0160045 | A1 * | 5/2023 | Sekimukai | C21D 9/02 420/41 |
| 2023/0250522 | A1 * | 8/2023 | Hirakawa | C22C 38/58 420/45 |
| 2023/0399728 | A1 * | 12/2023 | Tanaka | C21D 8/0226 |
| 2024/0060151 | A1 * | 2/2024 | Kawano | C22C 38/02 |
| 2024/0254609 | A1 * | 8/2024 | Seto | C22C 38/42 |
| 2025/0146098 | A1 * | 5/2025 | Jotoku | C21D 6/005 |
| 2025/0197982 | A1 * | 6/2025 | Kochi | C22C 38/001 |

FOREIGN PATENT DOCUMENTS

| | | | |
|---|---|---|---|
| JP | 9-310157 | A | 12/1997 |
| JP | 5618057 | B2 | 11/2014 |
| JP | 2018-109215 | A | 7/2018 |
| JP | 2019-31717 | A | 2/2019 |
| JP | 2021-504587 | A | 2/2021 |
| JP | 2021-66928 | A | 4/2021 |
| WO | WO 2004/111285 | A1 | 12/2004 |
| WO | WO 2020/251002 | A1 | 12/2020 |

OTHER PUBLICATIONS

International Preliminary Report on Patentability and English translation of the Written Opinion of the International Searching Authority (Forms PCT/IB/338, PCT/IB/373 and PCT/ISA/237) for International Application No. PCT/JP2022/026840, dated Feb. 15, 2024. International Search Report for PCT/JP2022/026840 (PCT/ISA/210) mailed on Oct. 4, 2022.

* cited by examiner

*Primary Examiner* — Jophy S. Koshy

(74) *Attorney, Agent, or Firm* — Birch, Stewart, Kolasch & Birch, LLP

(57) ABSTRACT

An austenite stainless steel material includes, on a mass basis, 0.024% or less of C, 1.00% or less of Si, 2.00% or less of Mn, 0.045% or less of P, 0.015% or less of S, 10.0 to 15.0% of Ni, 15.0 to 22.0% of Cr, 2.0 to 4.0% of Mo, 0.01 to 0.15% of N, 0.001 to 0.010% of B, 0.05 to 1.00% of Co, 0.01 to 0.30% of V, 0.01 to 0.30% of W, the balance being Fe and impurities.

9 Claims, No Drawings

AUSTENITE STAINLESS STEEL MATERIAL, METHOD FOR PRODUCING SAME, AND DESIGNED ARTICLES

FIELD OF THE INVENTION

The present invention relates to an austenite stainless steel material, a method for producing the same, and a designable article.

BACKGROUND OF THE INVENTION

Stainless steel materials are used in various applications because of their good properties such as corrosion resistance. For example, SUS 316, which is a type of austenite stainless steel material having good corrosion resistance, is often used for housings and components of smart phones, watches, and the like.

Further, when stainless steel materials are used for articles in which consumers can be visually recognized, such as housings, good designability is required for the stainless steel materials, from the viewpoint of increasing consumer's willingness to buy. The designability depends on the periods and needs, but for example, it is required to increase glossiness and impart high-class feeling by applying mirror polishing after cutting a stainless steel material. Also, scratches due to rubbing or the like impair the designability, so that it is also required to make it difficult to create scratches.

As an austenite stainless steel material having a composition based on SUS 316, for example, Patent Literature 1 discloses an austenite stainless steel material including, in % by weight, 0.05% or less of C, 1.0% or less of Si, 0.5 to 2.0% of Mn, 16 to 24% of Cr, 10 to 16% of Ni, 0.2% or less of N, and 4.0% or less of Mo, the balance being Fe and inevitable impurities. Further, Patent Literature 2 describes an austenite stainless steel material including, in % by mass, 0.03 to 0.18% of C, 0.05 to 0.30% of N, 1.5% or less of Si, 2.0% or less of Mn, 8.0 to 15.0% of Ni, 15.0 to 25.0% of Cr, 0.20 to 3.0% of Mo, and 2.0% or less of Cu, the balance being Fe and inevitable impurities.

PRIOR ART

Patent Literatures

[PTL 1]
Japanese Patent Application Publication No. 2021-504587 A
[PTL2]
Japanese Patent No. 5618057 B

SUMMARY OF THE INVENTION

Problem to be Solved by the Invention

In general, SUS 316 has good corrosion resistance, but it has a problem of an insufficient machinability due to its high cutting resistance. Also, mirror polishing after cutting tends to be difficult for materials having high cutting resistance. On the other hand, the scratch resistance can be improved by increasing the strength of the matrix phase, but an increase in the strength of the matrix phase increases the cutting resistance and reduces the machinability.

Further, although the austenite stainless steel material of Patent Literature 1 has good corrosion resistance and good non-magnetic properties, the Patent Literature 1 does not particularly pay attention to the machinability, the mirror polishability, and the scratch resistance.

Furthermore, the austenite stainless steel material of Patent Literature 2 has good corrosion resistance as well as good workability such as plastic working and cutting, and has a function of hydrogen brittleness resistance, but Patent Literature 2 does not particularly pay attention to the mirror polishability and scratch resistance.

The present invention was made in order to solve the above problems, and an object of the present invention is to provide an austenite stainless steel material having an improved machinability, mirror polishability and scratch resistance, and a method for producing the same.

Further, an object of the present invention is to provide a designable article which can be produced by cutting and mirror-polishing an austenite stainless steel material, has a high glossiness and high-grade feeling, and has improved scratch resistance.

Means for Solving the Problem

The machinability of the austenite stainless steel material is affected by strength and a degree of ductility of the matrix phase. That is, the machinability of the austenite stainless steel material can be improved by reducing the ductility of the matrix phase without increasing the strength of the matrix phase. Therefore, the present inventors have tried to suppress an increase in the strength of the matrix phase while decreasing the ductility of the matrix by solutionizing minor amounts of V and W in the matrix phase.

Further, the mirror polishability of the austenite stainless steel material is affected by the presence of inclusions, coarse carbides, and $\overline{\delta}$ ferrite. Also, if seizure occurs due to mirror polishing, or scabs that occur during hot rolling (hereinafter referred to as "hot scabs") remain, the glossiness may be decreased, and so the seizure and scabs should be suppressed. Therefore, the present inventors have tried to reduce the amounts of Al and Ca that will form inclusions as much as possible, adjust the contents of S, B, V and W to suppress the formation of coarse carbides, and improve the heat resistance by adding Co and W to suppress the occurrence of the hot scabs.

Furthermore, the scratch resistance of the austenite stainless steel material can be improved by depositing fine hard carbides into the matrix phase. Therefore, the present inventors have tried to improve the scratch resistance by adding V and W, which tend to form fine hard carbides.

Based on the above viewpoints, the present inventors have produced and analyzed austenite stainless steel materials having various compositions based on the composition of SUS 316 having good corrosion resistance, and as a result, they have found that a specific composition allows all of the machinability, the mirror polishability and the scratch resistance to be improved, and completed the present invention.

Thus, the present invention relates to an austenite stainless steel material comprising, on a mass basis, 0.024% or less of C, 1.00% or less of Si, 2.00% or less of Mn, 0.045% or less of P, 0.015% or less of S, 10.0 to 15.0% of Ni, 15.0 to 22.0% of Cr, 2.0 to 4.0% of Mo, 0.01 to 0.15% of N, 0.001 to 0.010% of B, 0.05 to 1.00% of Co, 0.01 to 0.30% of V, 0.01 to 0.30% of W, the balance being Fe and impurities.

The present invention also relates to a designable article comprising the austenite stainless steel material.

The present invention also relates to a method for producing an austenite stainless steel material, the method comprising subjecting a slab to hot rolling by heating it at a temperature of 1230 to 1300° C., wherein the slab comprises, on a mass basis, 0.024% or less of C, 1.00% or less of Si, 2.00% or less of Mn, 0.045% or less of P, 0.015% or less of S, 10.0 to 15.0% of Ni, 15.0 to 22.0% of Cr, 2.0 to 4.0% of Mo, 0.01 to 0.15% of N, 0.001 to 0.010% of B, 0.05 to 1.00% of Co, 0.01 to 0.30% of V, 0.01 to 0.30% of W, the balance being Fe and impurities, and wherein the slab has 0 to 3.0% by volume of $\overline{\text{o}}$ ferrite phase at a depth of 5 mm from a surface of the slab in a thickness direction.

Effects of the Invention

According to the present invention, it is possible to provide an austenite stainless steel material having an improved machinability, mirror polishability and scratch resistance, and a method for producing the same.

Further, according to the present invention, it is possible to provide a designable article which can be produced by cutting and mirror-polishing an austenite stainless steel material, has a high glossiness and high-grade feeling, and has improved scratch resistance.

DETAILED DESCRIPTION OF THE INVENTION

Hereinafter, embodiments of the present invention will be specifically described. It is to understand that the present invention is not limited to the following embodiments, and those which have appropriately added changes, improvements and the like to the following embodiments based on knowledge of a person skilled in the art without departing from the spirit of the present invention fall within the scope of the present invention.

It should be noted that, as used herein, the expression "%" in relation to any component means "% by mass", unless otherwise specified.

The austenite stainless steel material according to the present invention contains, on a mass basis, 0.024% or less of C, 1.00% or less of Si, 2.00% or less of Mn, 0.045% or less of P, 0.015% or less of S, 10.0 to 15.0% of Ni, 15.0 to 22.0% of Cr, 2.0 to 4.0% of Mo, 0.01 to 0.15% of N, 0.001 to 0.010% of B, 0.05 to 1.00% of Co, 0.01 to 0.30% of V, 0.01 to 0.30% of W, the balance being Fe and impurities.

The term "austenite" as used herein means that the metal structure is mainly made of austenite phases at ordinary temperature. Therefore, the "austenite" includes those containing minor amounts of phases other than the austenite phase (for example, ferrite phases, martensite phases, etc.).

Also, the term "stainless steel material" as used herein means a material formed of stainless steel, and a shape of the material is not particularly limited. Examples of the shape include a sheet shape (including a strip shape), a rod shape, and a tubular shape. Further, the material may be various shaped steels having cross-sectional shapes such as T-shape and I-shape.

Further, as used herein, the term "impurities" means components which are contaminated due to various factors such as raw materials including ore and scrap, and production steps, when the austenite stainless steel material is industrially produced, and which are acceptable in a range that does not adversely affect the present invention. For example, elements such as O are also included in the impurities. The content of O contained as an impurity is generally 0.030% or less.

Furthermore, with respect to the content of each element as used herein, containing or comprising "xx % or less" means that it contains xx % or less but contains an amount more than 0% (especially, more than the impurity level).

Further, the austenite stainless steel material according to an embodiment of the present invention may further contain one or more selected from Al: 0.03% or less and Ca: 0.006% or less. Therefore, the austenite stainless steel material according to the embodiment of the present invention containing these elements can be represented as further including C: 0.024% or less, Si: 1.00% or less, Mn: 2.00% or less, P: 0.045% or less, S: 0.015% or less, Ni: 10.0 to 15.0%, Cr: 15.0 to 22.0%, Mo: 2.0 to 4.0%, N: 0.01 to 0.15%, B: 0.001 to 0.010%, Co: 0.05 to 1.00%, V: 0.01 to 0.30%, and W: 0.01 to 0.30%, and further including one or more selected from Al: 0 to 0.03%, and Ca: 0 to 0.006%, the balance being Fe and impurities.

Here, with regard to the content of each element in this specification, including or comprising "0 to xx %" is a concept encompassing that it includes xx % or less, but also includes 0% (it is a case where it is not included).

Each component will be described in detail below.

<C: 0.024% or Less>

C is an element forming an austenite phase (y phase) and is an effective element for increasing the strength of the matrix phase. In particular, the C can bind to V and W to deposit fine hard carbides into the matrix phase, so that the scratch resistance can be improved. However, if the C content is too high, the hard carbides tend to be coarsened and the mirror polishability is deteriorated. Therefore, the upper limit of the C content is controlled to 0.024%, preferably 0.023%. On the other hand, the lower limit of the C content is not particularly limited, but it may preferably be 0.001%, and more preferably 0.003%, and still more preferably 0.005%, from the viewpoint of obtaining the above effect of C.

<Si: 1.00% or Less>

If the Si content is too high, the workability of the austenite stainless steel material will be deteriorated. Therefore, the upper limit of the Si content is controlled to 1.00%, and preferably 0.98%, and more preferably 0.96%. On the other hand, the lower limit of the Si content is not particularly limited, but it may preferably be 0.01%, and more preferably 0.05%, and still more preferably 0.10%.

<Mn: 2.00% or Less>

Mn is an element forming the austenite phase. If the Mn content is too high, the corrosion resistance of the austenite stainless steel material will be decreased. Therefore, the upper limit of the Mn content is controlled to 2.00%, and preferably 1.95%, and more preferably 1.90%. On the other hand, the lower limit of the Mn content is not particularly limited, but it may preferably be 0.01%, and more preferably 0.05%, and still more preferably 0.10%.

<P: 0.045% or Less>

If the P content is too high, the workability of the austenite stainless steel material will be deteriorated. Therefore, the upper limit of the P content is controlled to 0.045%, and preferably 0.043%. On the other hand, the lower limit of the P content is not particularly limited, but it may preferably be 0.001%, and more preferably 0.005%, and still more preferably 0.010%.

<S: 0.015% or Less>

If the S content is too high, the producibility of the austenite stainless steel material will be deteriorated, and inclusions will be easily formed, leading to impaired mirror polishability. Therefore, the upper limit of the S content is controlled to 0.015%, and preferably 0.014%. On the other hand, the lower limit of the S content is not particularly limited, but it may preferably be 0.0001%, and more preferably 0.0003%, and still more preferably 0.0005%.

<Ni: 10.0 to 15.0%>

As with the Mn, Ni is an element forming the austenite phase. Since the Ni is expensive, an excessive Ni content leads to an increase in production costs. Therefore, the upper limit of the Ni content is controlled to 15.0%, and preferably 14.8%, and more preferably 14.6%. On the other hand, if the Ni content is too low, the corrosion resistance and workability of the austenite stainless steel material will be deteriorated, and it will be difficult to obtain an austenitic structure. Therefore, the lower limit of the Ni content is controlled to 10.0%, and preferably 10.3%, and more preferably 10.5%.

<Cr: 15.0 to 22.0%>

Cr is an effective element for improving the corrosion resistance of the austenite stainless steel material. However, if the Cr content is too high, the formation of δ ferrite will reduce the mirror polishability of the austenite stainless steel material. Therefore, the upper limit of the Cr content is controlled to 22.0%, and preferably 21.8%, and more preferably 21.6%. On the other hand, if the Cr content is too low, any sufficient corrosion resistance cannot be obtained. Therefore, the lower limit of the Cr content is controlled to 15.0%, and preferably 15.2%.

<Mo: 2.0 to 4.0%>

Mo is an element added to improve the corrosion resistance. However, Mo is expensive. Therefore, if the Mo content is too high, it leads to an increase in production costs. Therefore, the upper limit of the Mo content is controlled to 4.0%, and preferably 3.9%. On the other hand, the lower limit of the Mo content is 2.0%, and preferably 2.1%, and more preferably 2.2%, and still more preferably 2.5%, from the viewpoint of ensuring the corrosion resistance.

<N: 0.01 to 0.15%>

N is an effective element for improving the corrosion resistance. To obtain this effect, the lower limit of the N content is controlled to 0.01%, and preferably 0.02%. On the other hand, if the N content is too high, the workability of the austenite stainless steel material will be deteriorated. Therefore, the upper limit of the N content is controlled to 0.15%, and preferably 0.14%.

<B: 0.001 to 0.010%>

B is an effective element for improving hot workability (suppressing hot scabs). To obtain this effect, the lower limit of the B content is controlled to 0.001%, and preferably 0.002%. On the other hand, if the content of B is too high, the effect of B is saturated, and conversely, the mirror polishability is decreased due to the formation of boride precipitates. Therefore, the upper limit of the B content is controlled to 0.010%, and preferably 0.009%.

<Co: 0.05 to 1.00%>

Co is an element that suppresses scales generated due to processing heat at a cut portion when cutting the austenite stainless steel material. Co is also an element that improves the corrosion resistance after mirror polishing. In order to obtain these effects, the lower limit of the Co content is controlled to 0.05%, and preferably 0.06%. On the other hand, if the Co content is too high, the effect of Co is saturated and the cutting resistance is increased, resulting in poor machinability. Therefore, the upper limit of the Co content is controlled to 1.00%, and preferably 0.98%, and more preferably 0.95%.

<V: 0.01 to 0.30%>

V is an element that binds to C to deposit fine hard carbides into the matrix phase. These fine hard carbides can improve the scratch resistance without impairing the mirror polishability. Also, a part of V forms a solid solution in the matrix phase and decreases the ductility of the matrix phase. This results in a decrease in cutting resistance, so that the machinability can be improved. To obtain these effects, the lower limit of the V content is controlled to 0.01%, and preferably 0.02%. On the other hand, if the V content is too high, carbides and nitrides of V tend to be coarsened, resulting in poor mirror polishability. Therefore, the upper limit of the V content is controlled to 0.30%, and preferably 0.29%.

<W: 0.01 to 0.30%>

As with the V, W is an element that binds to C to deposit fine hard carbides into the matrix phase. These fine hard carbides can improve the scratch resistance without impairing the mirror polishability. Also, a part of W forms a solid solution in the matrix phase and decreases the ductility of the matrix phase. It results in a decrease in cutting resistance, so that the machinability can be improved. In order to obtain these effects, the lower limit of the W content is controlled to 0.01%, and preferably 0.02%. On the other hand, if the W content is too high, carbides and nitrides of W tend to be coarsened, resulting in poor mirror polishability. Therefore, the upper limit of the W content is controlled to 0.30%, and preferably 0.29%.

<Al: 0.03% or Less>

Al is an element that is optionally added for deoxidation in a refining step and improves the corrosion resistance and the heat resistance. On the other hand, Al is an element forming inclusions that will reduce the mirror polishability. Therefore, the upper limit of the Al content is controlled to 0.03%, and preferably 0.02%. On the other hand, since Al may not be contained, the lower limit is not particularly limited. The lower limit when Al is included is, for example, 0.01%.

<Ca: 0.006% or Less>

Ca is an element that is optionally added to improve hot workability. On the other hand, Ca is an element forming inclusions that will reduce the mirror polishability. Therefore, the upper limit of the Ca content is controlled to 0.006%, and preferably 0.005%. On the other hand, since Ca may not be contained, the lower limit is not particularly limited. The lower limit when Ca is included is, for example, 0.001%.

The austenite stainless steel material according to the embodiment of the present invention preferably satisfies the following equation (1):

$$5W + 2V + 0.45 - Co \geq 0 \quad (1)$$

In the equation, the symbol of each element represents a content (% by mass) of each element.

The above equation (1) is an index representing the balance of W, V, and Co contents that will affect the machinability, mirror polishability, and scratch resistance. By satisfying the above equation (1), the contents of W, V and Co can be controlled in an appropriate balance, so that the machinability, mirror polishability and scratch resistance can be stably improved.

The austenite stainless steel material according to the embodiment of the present invention preferably has contents of C and N of less than 0.080%.

C and N are also elements that affect the hardness of the austenite stainless steel material, and a decrease in the contents of these elements can soften the austenite stainless steel material and further improve the workability. For this purpose, the total amount of C and N is preferably less than 0.080%, and more preferably 0.075% or less, and even more preferably 0.070% or less.

The austenite stainless steel material according to the embodiment of the present invention preferably has a metal structure containing 0 to 2.0% by volume of δ ferrite phase.

The δ ferrite phase has an adverse effect on the mirror polishability, and if it is present in a large amount in the austenite stainless steel material, it reduces the glossiness of the product. Therefore, the content of the δ ferrite phase is preferably 0 to 2.0% by volume, and more preferably 0 to 1.5% by volume, and even more preferably 0 to 1.0% by volume.

As used herein, "0 vol % of δ ferrite phase" means that the δ ferrite phase is not included.

A ratio of the δ ferrite phases in the austenite stainless steel material according to the embodiment of the present invention is determined by a magnetic induction method. For example, the ratio of the δ ferrite phases can be measured using a ferrite scope (for example, FERITSCOPE FMP30 manufactured by Fisher Instruments).

The austenite stainless steel material according to the embodiment of the present invention preferably has a cutting resistance value of 270 N or less, and more preferably 240 N or less, and even more preferably 220 N or less. If the cutting resistance value is in such a range, it can be said that the cutting resistance is low, so that the machinability can be improved. Although the lower limit of the cutting resistance value is not particularly limited, it is, for example, 100 N.

Here, the cutting resistance value can be measured by a cutting test in which an austenite stainless steel material is slotted using an end mill (from Korloy; an outer diameter of @12 mm). In the slotting, the cutting resistance is defined as a horizontal component force (feed component force) acting in a feed direction. The slotting conditions are as follows:

Cutting velocity (Vc): 96 m/min;
Rotation speed: 2550 rpm;
Feed rate per blade (Fz): 0.025 mm/min;
Feeding velocity (Vf): 255 mm/min;
Cut depth in axial direction (Ap): 5 mm; and
Wet processing (with cutting oil).

The austenite stainless steel material according to the embodiment of the present invention preferably has a glossiness Gs(20°) of 1000% or more, and more preferably 1030% or more, and even more preferably 1050% or more, after the mirror polishing. If the glossiness is in such a range, it can be said that the mirror polishability is improved, and the seizure and hot scabs can be suppressed. Although the upper limit of the glossiness Gs(20°) is not particularly limited, it is, for example, 1500%.

As used herein, the glossiness Gs(20°) means a specular gloss at an angle of 20° measured in accordance with JIS Z8741: 1997. The glossiness Gs(20°) can be measured in accordance with JIS Z8741: 1997 using a glossiness meter (Micro-Tri-Gloss manufactured by BYK-Gardner). The glossiness Gs(20°) is measured at arbitrary five points excluding a range up to 5 mm from the end portion, and an average value thereof is defined as the evaluation result. Also, a distance between the respective measurement positions should be 5 mm or more.

The austenite stainless steel material according to the embodiment of the present invention preferably has a comparative abrasion quantity of $60\times10^{-5}$ $mm^3/N\cdot m$ or less, and preferably $55\times10^{-5}$ $mm^3/N\cdot m$ or less, and more preferably $50\times10^{-5}$ $mm^3/N\cdot m$ or less, in a pin-on-disk abrasion test. If the comparative abrasion quantity is in such a range, it can be said that the scratch resistance is improved. Although the lower limit of the comparative abrasion quantity is not particularly limited, it is, for example, $10\times10^{-5}$ $mm^3/N\cdot m$.

Here, the comparative abrasion quantity in the pin-on-disk abrasion test can be measured by cutting out a disk-shaped sample having a diameter of 8 mm from the austenite stainless steel material and using a pin-on-disk abrasion tester. The pin-on-disk abrasion test is conducted by fixing the disk-shaped sample to a sample holder and pressing the surface of the sample against rotating abrasive paper (#800 abrasive paper coated with SiC) with a test load F=20 N. At this time, a rotation speed is 0.66 m/see, a number of rotations is 140 rpm, and a friction distance Lis 200 m. Then, from a difference between the thicknesses of the samples before and after the pin-on-disk abrasion test, a volume of a material lost due to abrasion is calculated, and this is defined as an abrasion loss W ($mm^3$). Then, the comparative abrasion quantity is calculated by the following equation:

$$\text{Comparative abrasion quantity } (mm^3/Nm) = \text{abrasion loss } W/(\text{test load } F \times \text{friction distance } L)$$

The type of the austenite stainless steel material according to the embodiment of the present invention is not particularly limited as long as it has the above characteristics. For example, the austenite stainless steel material according to the embodiment of the present invention may be either a hot rolled steel material or a cold rolled steel material.

The austenite stainless steel material according to the embodiment of the present invention can be produced by a method known in the art, with the exception that the stainless steel satisfying the above composition is smelted. A typical production method will be described below, but the production method for the austenite stainless steel material according to the embodiment of the present invention is not limited to the following.

The austenite stainless steel material according to the embodiment of the present invention can be produced, for example, by subjecting a slab having the above composition to hot rolling. Cold rolling may be performed after the hot rolling depending on the applications. Furthermore, after the hot rolling and after the cold rolling, annealing and acid pickling may be performed as needed.

Conditions for the hot rolling, the cold rolling and the like are not particularly limited, and they may be appropriately adjusted depending on the composition of the components. For example, in the hot rolling, the hot rolling can be carried out at a heating temperature of 1200 to 1300° C. before rolling, and the annealing can be then performed at 1000 to 1200° C. if necessary. The heating temperature before rolling is preferably 1230 to 1300° C. Further, after the cold rolling, the annealing is preferably carried out at 1000 to 1150° C., if necessary.

Further, as described above, the austenite stainless steel material according to the embodiment of the present invention preferably has 0 to 2.0% by volume of δ ferrite phase. To produce such an austenite stainless steel material, it is preferable that the δ ferrite phase at a depth of 5 mm in the thickness direction from the surface of the slab subjected to the hot rolling is 0 to 3.0% by volume, and the heating temperature before the hot rolling is 1230 to 1300° C. If the δ ferrite phase at the relevant position of the slab is more than 3.0% by volume, the δ ferrite phase tends to remain even in the austenite stainless steel material, resulting in a decrease in mirror polishability.

The lower limit of the ratio of the δ ferrite phases at the relevant position of the slab is not necessarily required, but, from the viewpoint of suppressing the segregation of S to the grain boundary and the occurrence of scabs during the hot rolling, it is 0.1% by volume or more, and more preferably 0.2% by volume or more. It should be noted that when the scabs occur, the amount of cutting increases during polishing, so that the load of the cutting process increases.

Here, the ratio of the δ ferrite phase at the depth of 5 mm from the surface of the slab in the thickness direction can be obtained as follows. First, after removing oxide scales on the surface of the slab, the slab is cut in the thickness direction. Subsequently, on the cut surface in the thickness direction of the slab, the position at the depth of 5 mm in the thickness direction from the surface of the slab is specified, and the ratio of the δ ferrite phases at that position is measured with a ferrite scope (for example, FERITSCOPE FMP30 manufactured by Fisher Instruments).

Since the austenite stainless steel material according to the embodiment of the present invention has improved machinability, mirror polishability and scratch resistance, it can be used for various applications requiring these properties. For example, the austenite stainless steel material according to the embodiment of the present invention is suitable for use in designable articles that require various design properties such as high-grade feeling and profound feeling. Examples of designable articles include mobile terminals such as mobile phones, smartphones, tablet terminals, and notebook computers, housings for watches and the like, nameplates, and works of art.

The designable article according to an embodiment of the present invention includes the austenite stainless steel material as described above.

The designable article according to the embodiment of the present invention can be produced by cutting and mirror-polishing the above austenite stainless steel material, and has higher glossiness, high-grade feeling, and improved scratch resistance.

The method of cutting and mirror polishing are not particularly limited, and methods known in the art can be used. For example, the cutting can be performed using cutting tools such as bites, drills, end mills, and milling cutters.

The designable article according to the embodiment of the present invention can further include parts other than the above austenite stainless steel material. The other parts may be appropriately selected according to the type of the designable article, and are not particularly limited.

EXAMPLES

Hereinafter, the present invention will be described in detail with reference to Examples. However, it should not be construed that the present invention is limited to those Examples.

Examples 1 to 12 and Comparative Examples 1 to 9

Stainless steel having each composition as shown in Table 1 (the balance being Fe and impurities) was smelted to obtain a slab. For a part of the obtained slab, oxide scales on the surface of the slab were removed, and the slab was cut in the thickness direction. Subsequently, in the cut surface, the position at the depth of 5 mm in the thickness direction from the surface of the slab was specified, and at that position, the ratio of the δ ferrite phases was measured using a ferrite scope (FERITSCOPE FMP30 manufactured by Fisher Instruments). Table 2 shows the results. The obtained slab was then heated to each temperature as shown in Table 2, hot-rolled into a hot rolled sheet, and then annealed at 1000 to 1200° C. to obtain a hot rolled annealed sheet. The hot-rolled annealed sheet was then cold-rolled into a 6.0 mm cold-rolled sheet, and then annealed at 1000 to 1150° C. to obtain a cold-rolled annealed sheet (austenite stainless steel sheet).

TABLE 1

| Nos. | | Composition (% by mass) | | | | | | | | | | | | | | | | |
|---|---|---|---|---|---|---|---|---|---|---|---|---|---|---|---|---|---|---|
| | | C | Si | Mn | P | S | Ni | Cr | Mo | N | B | Co | V | W | Al | Ca | C + N | Eq. (1) |
| Example | 1 | 0.016 | 0.96 | 1.03 | 0.023 | 0.002 | 14.5 | 16.8 | 3.0 | 0.06 | 0.003 | 0.19 | 0.10 | 0.05 | 0.00 | 0.000 | 0.076 | 0.71 |
| | 2 | 0.011 | 0.55 | 0.64 | 0.030 | 0.007 | 13.5 | 15.9 | 2.7 | 0.04 | 0.002 | 0.83 | 0.12 | 0.19 | 0.01 | 0.000 | 0.051 | 0.81 |
| | 3 | 0.009 | 0.74 | 0.75 | 0.028 | 0.002 | 14.8 | 18.1 | 2.1 | 0.02 | 0.004 | 0.52 | 0.07 | 0.25 | 0.02 | 0.000 | 0.029 | 1.32 |
| | 4 | 0.014 | 0.48 | 0.98 | 0.025 | 0.001 | 13.6 | 17.6 | 2.6 | 0.09 | 0.002 | 0.32 | 0.09 | 0.06 | 0.01 | 0.001 | 0.104 | 0.61 |
| | 5 | 0.022 | 0.94 | 1.89 | 0.016 | 0.006 | 10.5 | 15.2 | 3.9 | 0.14 | 0.001 | 0.26 | 0.01 | 0.29 | 0.02 | 0.001 | 0.162 | 1.66 |
| | 6 | 0.015 | 0.37 | 0.93 | 0.022 | 0.012 | 14.6 | 18.3 | 2.2 | 0.02 | 0.009 | 0.92 | 0.05 | 0.21 | 0.02 | 0.002 | 0.035 | 0.68 |
| | 7 | 0.023 | 0.30 | 1.74 | 0.043 | 0.002 | 14.3 | 21.6 | 2.0 | 0.13 | 0.007 | 0.06 | 0.29 | 0.17 | 0.01 | 0.005 | 0.153 | 1.82 |
| | 8 | 0.007 | 0.33 | 0.78 | 0.025 | 0.014 | 13.8 | 15.5 | 2.4 | 0.10 | 0.002 | 0.27 | 0.07 | 0.02 | 0.01 | 0.002 | 0.107 | 0.42 |
| | 9 | 0.018 | 0.35 | 1.26 | 0.034 | 0.002 | 13.3 | 19.2 | 2.9 | 0.12 | 0.003 | 0.84 | 0.03 | 0.06 | 0.01 | 0.002 | 0.138 | −0.03 |
| | 10 | 0.018 | 0.51 | 1.01 | 0.020 | 0.002 | 13.4 | 17.8 | 2.5 | 0.08 | 0.001 | 0.29 | 0.09 | 0.05 | 0.03 | 0.001 | 0.098 | 0.59 |
| | 11 | 0.013 | 0.47 | 1.00 | 0.026 | 0.001 | 13.7 | 17.5 | 2.4 | 0.07 | 0.003 | 0.35 | 0.08 | 0.06 | 0.01 | 0.006 | 0.083 | 0.56 |
| | 12 | 0.015 | 0.43 | 0.92 | 0.027 | 0.001 | 13.4 | 17.7 | 2.4 | 0.10 | 0.002 | 0.33 | 0.11 | 0.05 | 0.01 | 0.002 | 0.115 | 0.59 |
| Comparative Example | 1 | 0.020 | 0.57 | 0.56 | 0.040 | 0.003 | 13.8 | 20.3 | 1.9 | 0.11 | 0.006 | 1.09 | 0.07 | 0.09 | 0.01 | 0.004 | 0.130 | −0.05 |
| | 2 | 0.014 | 0.40 | 1.00 | 0.027 | 0.013 | 14.4 | 19.0 | 2.1 | 0.03 | 0.008 | 0.85 | 0.04 | 0.32 | 0.02 | 0.001 | 0.044 | 1.28 |
| | 3 | 0.016 | 0.33 | 1.37 | 0.033 | 0.003 | 13.0 | 18.6 | 2.8 | 0.12 | 0.003 | 0.79 | 0.35 | 0.04 | 0.01 | 0.003 | 0.136 | 0.56 |
| | 4 | 0.008 | 0.74 | 1.11 | 0.040 | 0.006 | 14.7 | 15.3 | 2.2 | 0.05 | 0.002 | 0.00 | 0.08 | 0.12 | 0.01 | 0.002 | 0.058 | 1.21 |
| | 5 | 0.020 | 0.83 | 0.74 | 0.036 | 0.011 | 13.7 | 19.2 | 2.7 | 0.13 | 0.009 | 0.09 | 0.00 | 0.03 | 0.02 | 0.002 | 0.150 | 0.51 |
| | 6 | 0.006 | 0.69 | 0.99 | 0.034 | 0.005 | 10.9 | 17.8 | 3.3 | 0.14 | 0.004 | 0.36 | 0.04 | 0.00 | 0.01 | 0.001 | 0.146 | 0.17 |
| | 7 | 0.028 | 0.49 | 1.12 | 0.038 | 0.016 | 13.2 | 18.5 | 2.3 | 0.11 | 0.006 | 0.45 | 0.16 | 0.18 | 0.01 | 0.003 | 0.138 | 1.22 |
| | 8 | 0.012 | 0.78 | 1.26 | 0.040 | 0.002 | 12.9 | 18.2 | 2.5 | 0.06 | 0.000 | 0.08 | 0.09 | 0.04 | 0.01 | 0.003 | 0.072 | 0.75 |
| | 9 | 0.007 | 0.67 | 0.94 | 0.025 | 0.003 | 13.1 | 22.9 | 3.4 | 0.05 | 0.003 | 0.64 | 0.20 | 0.24 | 0.01 | 0.002 | 0.057 | 1.41 |

Underlines indicate that they are outside the scope of the present invention.

Eq. (1) represents 5W + 2V + 0.45 − Co in which each element symbol represents a content (% by mass) of each element.

TABLE 2

| Nos. | | δ Ferrite Phase of Slab (5 mm depth) [% by volume] | Heating Temperature before Hot Rolling [° C.] |
|---|---|---|---|
| Example | 1 | 0 | 1240 |
| | 2 | 0 | 1230 |
| | 3 | 1.1 | 1230 |
| | 4 | 0.4 | 1250 |
| | 5 | 1.2 | 1250 |
| | 6 | 1.5 | 1240 |
| | 7 | 3.1 | 1270 |
| | 8 | 0 | 1290 |
| | 9 | 2.6 | 1260 |
| | 10 | 0.9 | 1250 |
| | 11 | 0.5 | 1240 |
| | 12 | 0.2 | 1240 |
| Comparative Example | 1 | 2.6 | 1280 |
| | 2 | 2.5 | 1290 |
| | 3 | 2.0 | 1280 |
| | 4 | 0 | 1260 |
| | 5 | 1.9 | 1230 |
| | 6 | 5.3 | 1250 |
| | 7 | 0.6 | 1230 |
| | 8 | 3.2 | 1240 |
| | 9 | 13.1 | 1230 |

The austenite stainless steel sheets obtained above were evaluated as follows.

<Ratio of δ Ferrite Phase>

A sample was cut out from each austenite stainless steel sheet, and the ratio of the δ ferrite phases was measured using a ferrite scope (FERITSCOPE FMP30 manufactured by Fisher Instruments). The measurement was performed at arbitrary three points on the surface of each sample, and an average value thereof was determined to be the result.

<Machinability: Cutting Resistance Value>

The cutting resistance value was measured according to the above method. In this evaluation, if the cutting resistance value is 270 N or less, it can be determined that the cutting resistance is low and the machinability is improved.

<Mirror Polishability: Glossiness Gs)(20°>

After cutting each austenite stainless steel sheet obtained above to a predetermined size to prepare a sample, the sample was placed on a lapping platen and mirror polishing was carried out by lapping. In the lapping, polishing was carried out by using alumina slurry and diamond slurry abrasives as lapping agents, adjusting the number of rotations of the lapping platen to 90 rpm and adjusting an applied pressure in a range of 150 to 300 g/cm$^2$.

The glossiness Gs(20°) was measured according to the above method for the mirror-polished surface of each sample. In this evaluation, if the glossiness Gs(20°) is 1000% or more, it can be determined that the glossiness is high and the mirror polishability is improved.

<Scratch Resistance: Comparative Abrasion Quantity>

After each austenite stainless steel sheet obtained above was cut into a predetermined size to prepare a sample, a pin-on-disk wear test was conducted according to the above method to calculate the comparative abrasion quantity. In this evaluation, if the comparative abrasion quantity is $60\times10^{-5}$ mm$^3$/N·m m or less, it can be determined that the comparative abrasion quantity is less and the scratch resistance is improved.

<Vickers Hardness>

After cutting each austenite stainless steel sheet obtained above into a predetermined size to prepare a sample, the Vickers hardness of the rolled surface (surface) of each sample was measured according to JIS Z2244: 2009. The Vickers hardness was measured under a condition of a load of 5 kg.

In this evaluation, if the Vickers hardness is less than 220 HV, it can be determined that the workability is improved.

Table 3 shows the above evaluation results.

TABLE 3

| Nos. | | δ Ferrite Phase [% by mass] | Cutting Resistance Value [N] | Glassiness GS (20°) [%] | Comparative Abrasion Quantity [$\times10^{-5}$mm$^3$/N · m] | Vickers Hardness [HV] |
|---|---|---|---|---|---|---|
| Example | 1 | 0 | 211 | 1347 | 37 | 176 |
| | 2 | 0 | 222 | 1276 | 35 | 164 |
| | 3 | 0.7 | 238 | 1099 | 33 | 156 |
| | 4 | 0.3 | 229 | 1310 | 41 | 192 |
| | 5 | 0.7 | 206 | 1159 | 28 | 224 |
| | 6 | 1.1 | 247 | 1043 | 39 | 161 |
| | 7 | 2.2 | 192 | 1076 | 25 | 229 |
| | 8 | 0 | 259 | 1071 | 52 | 194 |
| | 9 | 1.8 | 268 | 1305 | 53 | 213 |
| | 10 | 0.5 | 231 | 1064 | 40 | 192 |
| | 11 | 0.3 | 226 | 1091 | 43 | 185 |
| | 12 | 0 | 233 | 1049 | 38 | 198 |
| Comparative Example | 1 | 1.7 | 301 | 1197 | 41 | 207 |
| | 2 | 1.7 | 228 | 910 | 25 | 165 |
| | 3 | 1.2 | 236 | 878 | 36 | 211 |
| | 4 | 0 | 196 | 904 | 38 | 170 |
| | 5 | 1.3 | 254 | 965 | 66 | 223 |
| | 6 | 3.5 | 236 | 920 | 70 | 212 |
| | 7 | 0.3 | 220 | 889 | 40 | 210 |
| | 8 | 2.2 | 209 | 842 | 47 | 178 |
| | 9 | 8.4 | 189 | 863 | 39 | 183 |

As shown in Table 3, each of the austenite stainless steel sheets according to Examples 1 to 12 had the predetermined composition, and had improved machinability, improved mirror polishability, and improved scratch resistance.

On the other hand, the austenite stainless steel sheet according to Comparative Example 1 has the excessively high Co content and the excessively low Mo content, resulting in higher cutting resistance and insufficient machinability.

The austenite stainless steel sheet according to Comparative Example 2 had the excessively high W content, resulting in lower glossiness Gs(20°) lower and insufficient mirror polishability. This would be because carbides and nitrides of W were coarsened.

The austenite stainless steel sheet according to Comparative Example 3 had the excessively high V content, resulting in lower glossiness Gs(20°) and insufficient mirror polishability. This would be because carbides and nitrides of V were coarsened.

The austenite stainless steel sheet according to Comparative Example 4 did not contain Co, so that it had the lower glossiness Gs(20°) and insufficient mirror polishability. This would be because scales occurred during cutting, and the scales could not be removed even by mirror polishing.

Since the austenite stainless steel sheet according to Comparative Example 5 did not contain V, it had lower glossiness Gs (20°), insufficient mirror polishability, higher comparative abrasion quantity, and insufficient scratch resistance. This would be because fine hard carbides could not be deposited in the matrix phase and the carbides and nitrides were coarsened.

The austenite stainless steel sheet according to Comparative Example 6 did not contain W. Also, this austenite stainless steel sheet had an excessively large amount of δ ferrite phase. Therefore, due to these factors, the glossiness Gs(20°) was lower and the mirror polishability was not sufficient. Also, the austenite stainless steel sheet according to Comparative Example 6 had the higher comparative abrasion quantity and insufficient scratch resistance. This would be because fine hard carbides could not be deposited in the matrix phase and the carbides and nitrides were coarsened.

The austenite stainless steel sheet according to Comparative Example 7 had the excessively high C and S contents, so that the glossiness Gs(20°) was lower and the mirror polishability was insufficient. This would be because hard carbides were coarsened.

The austenite stainless steel sheet according to Comparative Example 8 did not contain B. Also, this austenite stainless steel sheet had an excessively large amount of δ ferrite phase. Therefore, due to these factors, the glossiness Gs(20°) was lower and the mirror polishability was not sufficient. This would be because hot scabs were formed and could not be removed even by mirror polishing.

The austenite stainless steel sheet according to Comparative Example 9 had the excessively high Cr content. Also, this austenite stainless steel sheet also had an excessively large amount of δ ferrite phase. Therefore, the glossiness Gs(20°) was lower and the mirror polishability was not sufficient. This would be because a large amount of δ ferrite remained.

As can be seen from the above results, according to the present invention, it is possible to provide an austenite stainless steel material having an improved machinability, mirror polishability and scratch resistance, and a method for producing the same.

Further, according to the present invention, it is possible to provide a designable article which can be produced by cutting and mirror-polishing an austenite stainless steel material, has a high glossiness and high-grade feeling, and has improved scratch resistance.

The invention claimed is:

1. An austenite stainless steel material comprising, on a mass basis, 0.024% or less of C, 1.00% or less of Si, 2.00% or less of Mn, 0.045% or less of P, 0.015% or less of S, 10.3 to 15.0% of Ni, 15.0 to 22.0% of Cr, 2.0 to 4.0% of Mo, 0.01 to 0.15% of N, 0.001 to 0.010% of B, 0.05 to 1.00% of Co, 0.01 to 0.30% of V, 0.01 to 0.25% of W, the balance being Fe and impurities, wherein the austenite stainless steel material has a cutting resistance value of 270 N or less, wherein the austenite stainless steel material has a glossiness Gs (20°) of 1000% or more after mirror polishing, and wherein the austenite stainless steel material has a comparative abrasion quantity of $60\times10^{-5}$ $mm^3/N\cdot m$ or less in a pin-on-disk abrasion test.

2. The austenite stainless steel material according to claim 1, wherein the austenite stainless steel material satisfies the following equation (1):

$$5W + 2V + 0.45 - Co \geq 0 \quad (1)$$

in which a symbol of each element represents a content in % by mass of each element.

3. The austenite stainless steel material according to claim 1, wherein the austenite stainless steel material has a total amount of C and N of less than 0.080% by mass.

4. The austenite stainless steel material according to claim 1, wherein the austenite stainless steel material has a metal structure comprising 0 to 2.0% by volume of δ ferrite phase.

5. The austenite stainless steel material according to claim 1, further comprising one or more selected from Al: 0.03% or less and Ca: 0.006% or less on a mass basis.

6. A designable article comprising the austenite stainless steel material according to claim 1.

7. A method for producing an austenite stainless steel material, the method comprising subjecting a slab to hot rolling by heating it at a temperature of 1230 to 1300° C., wherein the slab comprises, on a mass basis, 0.024% or less of C, 1.00% or less of Si, 2.00% or less of Mn, 0.045% or less of P, 0.015% or less of S, 10.3 to 15.0% of Ni, 15.0 to 22.0% of Cr, 2.0 to 4.0% of Mo, 0.01 to 0.15% of N, 0.001 to 0.010% of B, 0.05 to 1.00% of Co, 0.01 to 0.30% of V, 0.01 to 0.25% of W, the balance being Fe and impurities, and wherein the slab has 0 to 3.0% by volume of δ ferrite phase at a depth of 5 mm from a surface of the slab in a thickness direction, wherein the austenite stainless steel material has a cutting resistance value of 270 N or less, wherein the austenite stainless steel material has a glossiness Gs) (20°) of 1000% or more after mirror polishing, and wherein the austenite stainless steel material has a comparative abrasion quantity of $60\times10^{-5}$ $mm^3/N\cdot m$ or less in a pin-on-disk abrasion test.

8. The method for producing an austenite stainless steel material according to claim 7, wherein the slab satisfies the following equation (1):

$$5W + 2V + 0.45 - Co \geq 0 \quad (1)$$

in which a symbol of each element represents a content (% by mass) of each element.

9. The method for producing an austenite stainless steel material according to claim 7, wherein the slab has a total amount of C and N of less than 0.080% by mass.

* * * * *